US009693135B2

(12) United States Patent
Haas-Christensen et al.

(10) Patent No.: US 9,693,135 B2
(45) Date of Patent: Jun. 27, 2017

(54) DIFFERENTIAL MICROPHONE AND METHOD FOR DRIVING A DIFFERENTIAL MICROPHONE

(75) Inventors: Jelena Citakovic Haas-Christensen, Valby (DK); Tomasz Hanzlik, Wroclaw (PL); Ivan Riis Nielsen, Stenløse (DK); Daifi Haoues Sassene, Vaerlöse (DK); Tomasz Marczak, Szczecin (PL)

(73) Assignee: TDK Corporation, Tokyo (JP)

( * ) Notice: Subject to any disclaimer, the term of this patent is extended or adjusted under 35 U.S.C. 154(b) by 157 days.

(21) Appl. No.: 14/370,720

(22) PCT Filed: Jan. 5, 2012

(86) PCT No.: PCT/EP2012/050154
§ 371 (c)(1),
(2), (4) Date: Sep. 30, 2014

(87) PCT Pub. No.: WO2013/102499
PCT Pub. Date: Jul. 11, 2013

(65) Prior Publication Data
US 2015/0016635 A1 Jan. 15, 2015

(51) Int. Cl.
*H04R 3/00* (2006.01)
*H04R 19/01* (2006.01)
*H04R 1/08* (2006.01)

(52) U.S. Cl.
CPC ..... *H04R 3/00* (2013.01); *H04R 1/08* (2013.01); *H04R 19/016* (2013.01)

(58) Field of Classification Search
CPC ..... H04R 3/00
USPC ..... 357/416; 330/253; 345/204; 381/111, 381/121, 174, 191, 326; 455/326
See application file for complete search history.

(56) References Cited

U.S. PATENT DOCUMENTS 3,721,835 A * 3/1973 Hess ..... H03K 5/088 327/178
4,119,922 A * 10/1978 Schroder ..... H03G 7/08 330/110
4,181,818 A * 1/1980 Shenier ..... H04M 1/19 381/107
4,491,697 A * 1/1985 Tanaka ..... H04R 19/016 330/269

(Continued)

FOREIGN PATENT DOCUMENTS

EP 0065746 A2 1/1982
GB 2044583 A 10/1980

(Continued)

OTHER PUBLICATIONS

Choksi, O., et al., "Analysis of Switched-Capacitor Common-Mode Feedback Circuit," IEEE Transactions on Circuits and Systems, II: Analog and Digital Signal Processing, vol. 50, No. 12, Dec. 2003, 12 pages.

(Continued)

*Primary Examiner* — Gerald Gauthier
(74) *Attorney, Agent, or Firm* — Slater Matsil, LLP

(57) ABSTRACT
A differential microphone with improved biasing and a well defined common mode output voltage is connected to an amplifier that includes a differential amplifier stage and a common mode feedback circuit. The amplifier is in a feedback configuration.

20 Claims, 4 Drawing Sheets

(56) References Cited

U.S. PATENT DOCUMENTS 4,757,545 A 7/1988 Rosander
5,029,268 A * 7/1991 Pfandler ..... B06B 1/0261 331/158
5,170,133 A * 12/1992 Pernici ..... H03F 3/265 330/253
5,521,548 A * 5/1996 Sugawara ..... H04L 27/2332 327/350
5,790,684 A * 8/1998 Niino ..... H04M 1/6058 381/151
6,075,867 A * 6/2000 Bay ..... H04R 19/00 181/171
7,124,942 B2 * 10/2006 Steffen ..... G06K 7/0008 235/451
8,482,088 B2 * 7/2013 Laming ..... 257/416
2004/0152437 A1 * 8/2004 Behzad ..... H03D 7/1441 455/326
2004/0183598 A1 * 9/2004 Behzad ..... H03F 1/26 330/253
2007/0018318 A1 1/2007 Marsh et al.
2008/0310655 A1 * 12/2008 Holzmann ..... H04R 3/00 381/122
2009/0074211 A1 * 3/2009 Hirade ..... H04R 31/00 381/174
2009/0218642 A1 * 9/2009 Miller ..... B81C 1/00182 257/416
2010/0254544 A1 * 10/2010 Kimura ..... H04B 15/005 381/94.1
2010/0329487 A1 * 12/2010 David ..... H03F 3/187 381/174
2011/0013788 A1 * 1/2011 Izuchi ..... H04R 19/016 381/174
2011/0260788 A1 * 10/2011 Inukai ..... H03F 3/005 330/69
2012/0014541 A1 1/2012 Nakayama et al.
2012/0050236 A1 * 3/2012 Lo ..... H01P 1/2135 345/204
2012/0139066 A1 * 6/2012 Je ..... H04R 31/00 257/416
2013/0051582 A1 * 2/2013 Kropfitsch ..... H03F 1/56 381/111
2015/0016635 A1 * 1/2015 Haas-Christensen .... H04R 3/00 381/121

FOREIGN PATENT DOCUMENTS

GB 2330709 * 4/1999
JP 57193198 A 11/1982
WO 2011132240 A1 10/2011

OTHER PUBLICATIONS

Liu., J., et al., "Nonlinear model and system identification of a capacitive dual-backplate MEMS Microphone," Journal of Sound and Vibration, vol. 309, Sep. 14, 2007, pp. 276-292.

Martin, D. T., et al., "A Micromachined Dual-Backplate Capcitive Microphone for Aeroacoustic Measurements," Journal of Microelectromechanical Systems, vol. 16, No. 6, Dec. 2007, pp. 1289-1302.

Saukoski, M., et al., "Fully Integrated Charge Sensitive Amplifier for Readout of Micromechanical Capacitive Sensors," IEEE International Symposium on Circuits and Systems, May 23-26, 2005, pp. 5377-5380.

Yan, W., et al., "Continuous-Time Common-Mode Feedback Circuit for Applications with Large Output Swing and High Output Impedance," Desgin and Diagnostics of Electronic Circuits and Systems, Apr. 16-18, 2008, 5 pages.

* cited by examiner

DIFFERENTIAL MICROPHONE AND METHOD FOR DRIVING A DIFFERENTIAL MICROPHONE

This patent application is a national phase filing under section 371 of PCT/EP2012/050154, filed Jan. 5, 2012, which is incorporated herein by reference in its entirety.

TECHNICAL FIELD

The present invention refers to differential microphones and methods for driving such microphones. The invention further refers to means for interfacing differential condenser microphones, e.g., MEMS (MEMS=Micro-Electro-Mechanical Systems) or ECM's (ECM=electret condenser microphone).

BACKGROUND

Microphones such as MEMS microphones comprise a perforated backplate and a flexible membrane. The backplate and the membrane establish electrodes of a capacitor. Received sound signals induce oscillations of the membrane. Due to corresponding induced oscillations of the capacity, acoustic signals can be converted into electrical signals. In order to improve the signal quality of MEMS microphones, double backplate microphones or double membrane microphones can be created. In double backplate microphones, the membrane is arranged between two perforated backplates. In double membrane microphones, a perforated backplate is arranged between two flexible membranes. In each case, a microphone is obtained that comprises two capacitors and provides a differential output port. A differential port comprises two terminals where each terminal mainly provides the same absolute value of a voltage or a current but with opposite polarity. When signals propagate via differential signal ports or signal paths, common mode disturbances can easily be eliminated.

Although microphones with differential ports provide a better signal quality, their use, contrary to simpler microphones with a single capacitor as an acusto-electrical transducer, has not yet been commercialized, thus not much work has been devoted yet to methods to interface such microphones. Therefore, unsolved problems exist related to receiving and amplification of the signal from a differential microphone.

Microphones providing differential signals are known from U.S. Pat. No. 4,757,545, US 2008/0310655 A1 or US 2010/254544 A.

As a differential MEMS microphone electrically presents two capacitors, its electrodes have to be biased. Accompanying interface circuitry connected to the electrodes of the capacitor may provide a bias voltage for the capacitor. In previous works biasing is done by connecting a resistance element having a large resistance between the electrodes and ground.

Problems connected with receiving and amplifying a differential microphone signal such as differential microphone biasing, amplifier gain definition, influence of the parasitic capacitances at the interface nodes, differential microphone capacitances impedance conversion, obtaining low noise and low cut-off frequency of the amplifier response exist.

The signal quality depends on the quality of the acoustic capacitors' bias voltage. Further, the signal quality depends on the quality of the common mode output voltage. What is needed is a differential microphone with an improved bias voltage of the microphones acoustic capacitors and a better defined common mode output voltage and a method for driving such a microphone.

SUMMARY OF THE INVENTION

Embodiments of the present invention provide a differential microphone that can process differential signals from the microphone's acoustic capacitors, that provide a stable and well-defined bias voltage for the capacitor's electrodes and that is able to provide well defined common mode output voltage. Further embodiments of the present invention provide amplification of the differential microphone signal with well defined gain, i.e., a well defined amplification factor.

A differential microphone comprises a first microphone electrode, a central microphone electrode and a second microphone electrode. The microphone further comprises a differential output port and a differential amplifier stage. The amplifier stage has a differential input port and a differential output port being connected to the output port of the microphone. The microphone further comprises a common mode feedback circuit having a differential output port being connected to the output port of the microphone.

The common mode feedback circuit provides a well defined common mode output voltage.

Such a microphone provides means for interfacing a differential microphone by the presented electrical circuitry. The microphone solves existing problems connected with receiving and amplification of a differential microphone signal such as differential microphone biasing, amplifier gain definition, influence of the parasitic capacitances at the interface nodes, differential microphone capacitances impedance conversion, obtaining low noise and low cut-off frequency of the amplifier response.

Thus, the microphone has an amplifier connected to the microphone electrodes providing a bias voltage for the capacitors and a common mode output voltage for further circuits processing the amplified electrical signals encoding the received acoustical signals.

In this context, a connection denotes an electrical connection between circuit elements.

In one embodiment a first terminal of the amplifier's differential input port is connected to the first microphone electrode and a second terminal of the amplifiers differential input port is connected to the second microphone electrode.

This solution of an improved microphone can be based on a assembly where the microphone electrodes are electrically coupled to a MOS (metal-oxide-semiconductor) integrated circuit.

In one embodiment the amplifier stage has a control port and the common mode feedback circuit is connected to the amplifier stage's control port.

In one embodiment the differential microphone further comprises a first resistance element and a second resistance element. The first resistance element is connected between a first terminal of the output port and a first terminal of the input port. The second resistance element is connected between a second terminal of the output port and a second terminal of the input port. The first and the second resistance elements are part of an amplifier feedback circuit.

Further, a first and a second capacitive element may be connected in parallel with the feedback resistance elements.

Thus, the feedback circuit is connected to the acoustic capacitors and the microphone comprises a capacitive feedback as the microphone capacitors can be regarded as part of the feedback circuit.

In one embodiment the resistance elements comprise a first diode and a second diode being connected in parallel to and in the opposite direction of the first diode. The second diode's direction may be opposite to the first diode's.

The resistance elements have a resistance $R_F$ greater than 10 GΩ. This requirement is needed because the resistor should not degrade the noise performance of the microphone preamplifier. Additionally to provide that the amplifier is operational in the whole audio band the cut-off frequency of a microphone amplifier (inversely proportional to the size of this resistor) should be rather low, e.g., <20 Hz.

Voltage drop across diodes connected in this way is close to zero and a resistance element is obtained that has a very large resistance. This resistance element can be also a series of diode RE elements or can be implemented in different ways as a series or parallel connection of transistor or diode elements.

In one embodiment the common mode feedback circuit comprises a common mode voltage port for setting and adjusting the common mode voltage at the amplifier stage's output.

Differential microphone comprise a differential signal port connected to its double backplates or double membranes in the case of a double membrane microphone. The central electrode thereof is kept at a constant voltage representing signal ground. The bias voltage is generated by the electronic circuitry of the microphone's amplifier. A Dickson voltage multiplier followed by a low pass filter might be used for MEMS microphones, ECM microphones do not need this high bias voltage.

The amplifier stage can comprise a fully differential operational amplifier (opamp). The first and the second acoustic electrodes are connected to the input ports of the opamp. The differential gain of the opamp is typically greater than 1000. The amplifier stage may be a standard MOS topology such as folded cascode amplifier.

The DC voltage at the output of the amplifier is determined by the common mode voltage port by the amplifier's common-mode feedback circuit. Normally the DC voltage at the output of the amplifier determined by the common mode voltage port is set to half of a power supply voltage of the microphone.

The DC bias voltage of the acoustic capacitors may be generated on the same integrated circuit chip. Via the common mode control port, the DC voltage of the output of the amplifier stage and the microphone's differential output port is set to a value defined by the common mode control port. The same DC voltage will appear at the microphone's capacitors, i.e., the voltage drop on RE is close to zero. In this way, the DC voltage of the microphone capacitor is well defined and further more can be adjusted.

In one embodiment the amplifier stage's differential input port is connected to gates of a MOS transistors differential pair. Noise of these transistors, connected to the microphone electrodes should be low. Often a P-MOS input stage is used for better noise performance.

In one embodiment the microphone comprises a first capacitance element and a second capacitance element. The first capacitance element is connected between a first terminal of the output port and a first terminal of the amplifier stage's input port. The second capacitance element is connected between a second terminal of the output port and a second terminal of the amplifier stage's input port. The first and the second capacitance elements are part of an amplifier feedback circuit.

The capacitance elements may have a capacitance $C_F$ between 0.05 pF and 10 pF.

Further, the amplification factor is mainly proportional to $$(V_{out+}-V_{out-})/(V_{M1}-V_{M2})\approx C_M/C_F \quad \text{(eqn. 1)}$$

Thus, the microphone's gain is independent of parasitic capacitances of the capacitor. Here, $V_{out+}$ and $V_{out-}$ are the output voltages at the differential output terminals. $V_{M1}$-$V_{M2}$ is the voltage applied to the combination of the capacitors built up by two backplates and a membrane in between. $C_M$ is the capacitance of each single capacitor comprising the membrane and one backplate.

A desired property of the microphone described is that the gain can be adjusted through the first and second capacitance elements as feedback capacitors having a capacity $C_F$. In that case $C_F$ may be connected with some kind of switch arrangement by which the value of $C_F$ can be changed, i.e., programmed to give variable gain.

The cut-off frequency $\omega_{cut}$ of a microphone amplifier can, then, be denoted as $$\omega_{cut}=1/(C_F R_F) \quad \text{(eqn. 2)}$$

where $C_F$ is the capacitance of the first or the second capacitance element and $R_F$ is the resistance of the first or the second resistance element. Thus, with such a feedback configuration, the cut-off frequency $\omega_{cut}$ can be 20 Hz or lower. Thus, a low cut-off frequency $\omega_{cut}$ is obtained.

The first terminal and the second terminal establish the two terminals of a differential signal port of the operational amplifier. In this case, the operational amplifier is connected in a feedback configuration where the feedback network between the operational amplifier's (opamp's) output and the opamp's input comprises a resistance element having a very large resistance in parallel with feedback capacitor.

A purpose of the large resistance is to provide a DC path from the operational amplifier input to the output. At the same time this resistance element provides a DC path from the microphone electrodes through the output of the amplifier to ground. Keeping in mind that the amplifier's DC output voltage is set by its common-mode feedback circuitry, a microphone amplifier is provided in which an amplifier stage and a common mode feedback circuit are combined to improve the signal quality of a microphone. Such a combination enables a stable and well-defined DC bias voltage for a microphone's capacitor. The bias voltage is applied to the capacitor via the input port of the amplifier stage. Further, the common mode feedback circuit provides a stable and well-defined common mode output voltage to improve further processing of the electric signals.

Further, such a microphone amplifier provides impedance conversion of capacitive impedances of the microphone's capacitor. As a fully differential topology has been used, a low THD (total harmonic distortion) and a good power supply rejection, i.e., a good immunity against common mode disturbances from the power supply can be achieved.

In one embodiment the first microphone electrode, the central microphone electrode and the second microphone electrode are elements of the acoustically active part of a MEMS microphone or a electret condenser microphone.

The microphone can be produced in MEMS technology on a silicon chip and comprise circuit elements being fully integrated in an IC chip in CMOS process, e.g., an ASIC (ASIC=Application-Specific Integrated Circuit) chip. The two chips are packaged together. The MEMS microphone and the CMOS integrated circuitry can also be produced on the same silicon substrate, i.e., as a single chip. Separate CMOS chip with circuits described can also be connected to an electret condenser microphone to form the amplifier described. In all cases the amplifier with the feedback described can provide an amplification factor from 1 to 20. In all cases the differential microphone can have one membrane and two backplates or one backplate and two membranes.

In one embodiment the microphone further comprises a third capacitance element being connected between a first terminal of the amplifier stage's input port and the first microphone electrode and a fourth capacitance element being connected between a second terminal of the amplifier stage's input port and the second microphone electrode (E2). The third and the fourth capacitance element can have capacitances between 1 pF and 100 pF.

Thus, it is possible to separate, by these DC blocking capacitors, sensitive circuit elements of the input port of the amplifier from the electrodes of the microphone's capacitor. Especially during manufacturing steps, and when applying high bias voltage on the microphone, the amplifier is protected against high DC voltages at its input nodes which might damage the gate oxide of the input transistors.

In one embodiment a third resistance element is connected between the first microphone electrode and a high bias voltage generated by an integrated circuit. The first microphone electrode and the second microphone electrode are electrically connected. Thus, the acoustical capacitor's electrodes are connected to a bias voltage which may be on-chip generated.

In one embodiment the amplifier stage is a folded-cascode amplifier comprising a first, a second, a third, a fourth, a fifth, a sixth, a seventh, an eighth, a ninth, a tenth and an eleventh transistor, where the first, the second and the third transistor are connected to a power supply. The fourth transistor is connected between the second and the sixth transistor and the fifth transistor is connected between the third transistor and the seventh transistor. The eighth transistor is connected between the sixth transistor and ground and the ninth transistor is connected between the seventh transistor and ground. The tenth transistor is connected between the first transistor and the eighth transistor and the eleventh transistor is connected between the first transistor and the ninth transistor. The eighth transistor and the ninth transistor are connected to a control port.

This circuit is presented as an example, whereas it is possible to use many other high-gain amplifier stage implementations that can be found in the literature describing the field of art. The amplifier stage can be designed to have the optimal low noise performance when connected together with the microphone. The amplifier is usually designed to be operational under low-voltage and with low current consumption.

In one embodiment the amplifier stage comprises a first, a second, a third, a fourth, a fifth, a sixth, a seventh, an eighth, a ninth, a tenth, an eleventh and a twelfth transistor. The first transistor and the second transistor are connected to a power supply. The third transistor is connected between the first transistor and the seventh transistor and the fourth transistor is connected between the second transistor and the ninth transistor. The fifth transistor is connected between the first transistor and the eighth transistor and the sixth transistor is connected between the second transistor and the eighth transistor. The seventh transistor is connected between the third transistor and the tenth transistor and the ninth transistor is connected between the fourth transistor and the twelfth transistor. The eighth transistor is connected to the eleventh transistor. The tenth transistor, the eleventh transistor and the twelfth transistor are connected to ground. The tenth transistor, the eleventh transistor and the twelfth transistor are connected to a control port.

In one embodiment the common mode feedback circuit comprises a first, a second, a third, a fourth, a fifth, a sixth, a seventh and an eighth transistor. The first and the second transistor are connected to a power supply. The third transistor is connected between the first transistor and the seventh transistor. The fourth transistor is connected between the second transistor and the seventh transistor. The fifth transistor is connected between the first transistor and the eighth transistor. The sixth transistor is connected between the second transistor and the eighth transistor. The seventh transistor and the eighth transistor are connected to ground.

This circuit is presented as an example, whereas it is possible to use many other common-mode feedback implementations that can be found in the literature describing the field of art. Switched capacitor common-mode feedback might be used as well.

In one embodiment all circuit elements of the amplifier are fully integrated in a CMOS ASIC chip. The chip may be manufactured in a standard CMOS process.

The CMOS circuit chip is assembled together with the MEMS microphone chip in a package either by soldering to a PCB (printed circuit board) like substrate (ceramic or similar) or by wire bonding the two chips together.

Further, the amplifier and the microphone can be produced starting from the same silicon substrate forming a single chip solution.

A method for driving differential microphone, e.g., one of the above mentioned microphones, comprising the following steps: receiving an acoustical signal, converting the acoustical signal into an electrical signal, and adjusting the bias voltage of the first and second microphone electrode by adjusting a common mode voltage via a common mode voltage port (VCOM) of the common mode feedback circuit.

In one embodiment of the method the electrical signal is amplified with an adjustable and well defined gain insensitive to parasitic capacitances.

BRIEF DESCRIPTION OF THE DRAWINGS

The basic principles and exemplary embodiments thereof are shown in the schematic figures in which.

DETAILED DESCRIPTION OF ILLUSTRATIVE EMBODIMENTS

Figure 1:
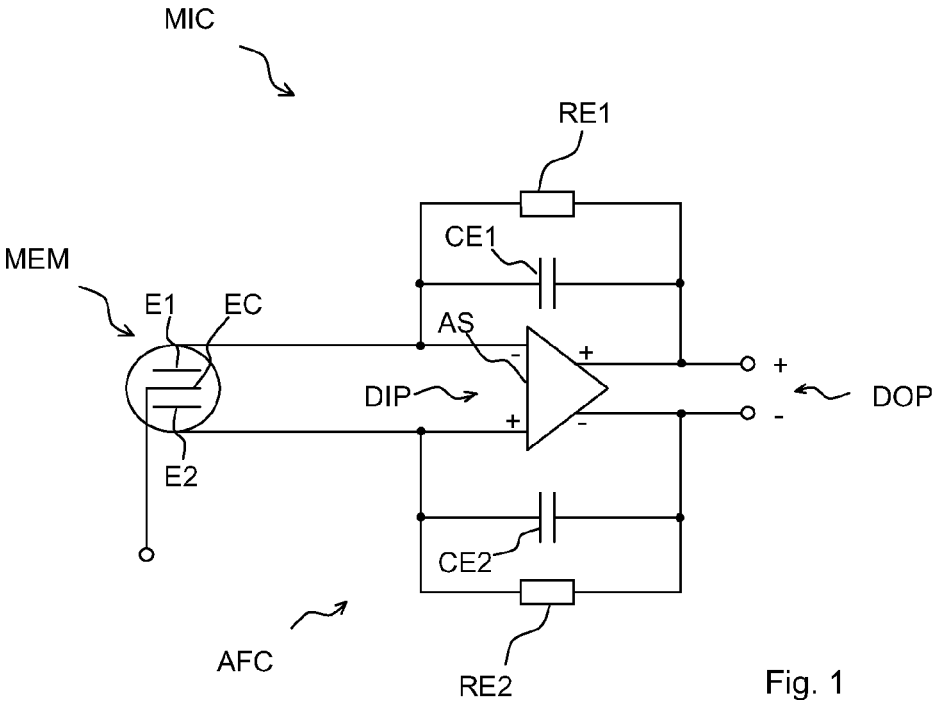
FIG. 1 shows an equivalent circuit diagram of a differential microphone.

FIG. 1 shows an equivalent circuit diagram of a differential microphone MIC comprising an amplifier stage AS being connected to the mechanical elements, i.e., the acoustical electrodes, of a MEMS microphone MEM. The mechanical elements MEM comprise a first electrode E1 and a second electrode E2. A central electrode EC is arranged between the first electrode E1 and the second electrode E2. The first electrode E1 and the second electrode E2 can be established by perforated backplates of a double backplate or by membranes of a double membrane microphone. The amplifier stage AS comprises a differential input port DIP.

The differential output of the amplifier stage AS is connected to the differential output DOP of the microphone MIC. The differential input port DIP comprises two terminals, each terminal receiving a signal of mainly the same absolute value but of different polarity compared to the respective other terminal's signal. A first resistance element RE1 is connected between an input terminal and an output terminal. A second resistance element RE2 is connected between the respective other input terminal and the respective other output terminal. The electric potential of the input terminal and the output terminal connected to one resistance element have an opposite polarity, i.e., the amplifier stage is in a negative feedback configuration. The first and second capacitance elements and the first and second resistance elements establish, thus, an amplifier feedback circuit AFC.

Further, a first capacitance element CE1 is connected between the first output terminal and the first input terminal. A second capacitance element CE2 is connected between the second output terminal and the second input terminal.

Figure 3A:
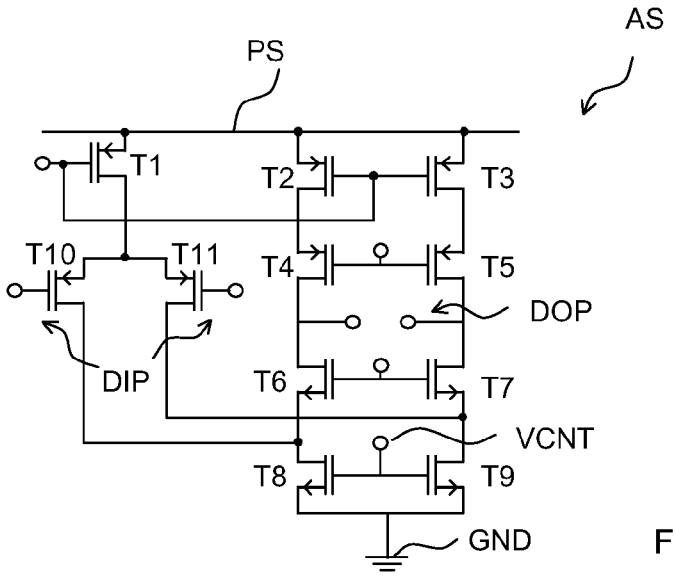
FIG. 3A shows an equivalent circuit diagram of an amplifier stage.
Figure 3B:
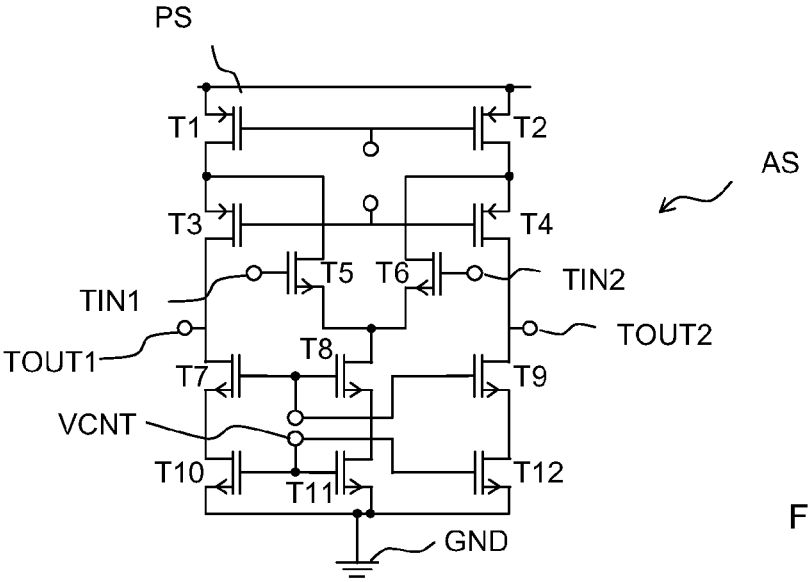
FIG. 3B shows an equivalent circuit diagram of another amplifier stage.
Figure 4A:
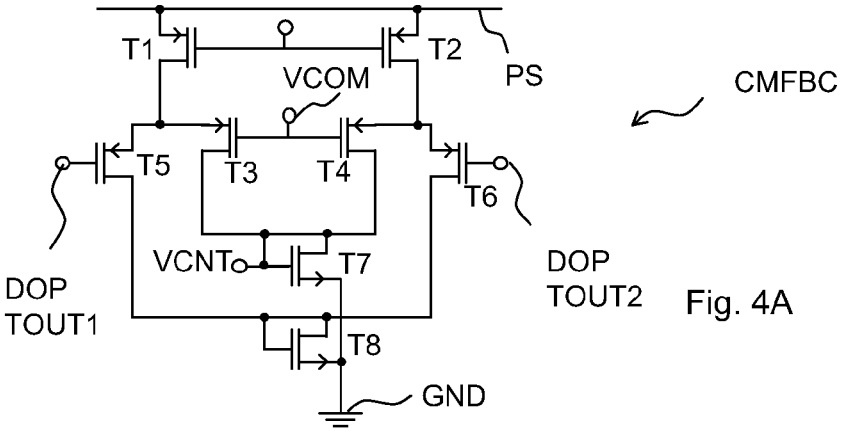
FIG. 4A shows an equivalent circuit diagram of a common mode feedback circuit that may be in use with the amplifier stage shown in FIG. 3A.
Figure 4B:
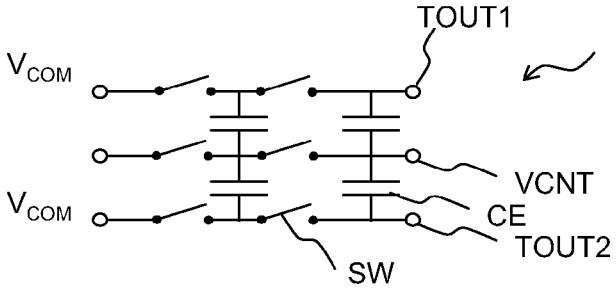
FIG. 4B shows an equivalent circuit diagram of another common mode feedback circuit that may be in use with the amplifier stage shown in FIG. 3B.

Embodiments of amplifier stages are shown in FIGS. 3A and 3B. Embodiments of common mode feedback circuits are shown in FIGS. 4A and 4B.

Figure 2:
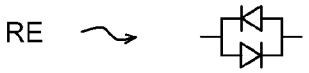
FIG. 2 shows an embodiment of a resistance element.

FIG. 2 shows an embodiment of a resistance element RE comprising diodes being connected in parallel but with opposite polarity with respect to each other. Thus, a large resistance for low voltages can be obtained.

FIG. 3A shows a more detailed circuit equivalent diagram of an amplifier stage AS comprising 11 transistors T1-T11. A power supply PS is connected to the respective source of a first transistor T1, of a second transistor T2, and of a third transistor T3. The gate of first transistor T1 is connected to the gate of the second transistor T2 and the third transistor T3. The drain of the first transistor T1 is connected to the sources of the tenth transistor T10 and the eleventh transistor T11. The gates of the tenth transistor T10 and the eleventh transistor T11 establish the respective input terminals of the differential input port DIP. The drains of the second transistor T2 and of the third transistor T3 are connected to the sources of the fourth transistor T4 and the fifth transistor T5.

The gate of the fourth transistor T4 is connected to the gate of the fifth transistor T5. The drains of the fourth transistor T4 and the fifth transistor T5 are connected to the differential output port DOP of the common mode feedback circuit. The ports' respective terminals are connected to the drains of the sixth transistor T6 and the seventh transistor T7 both the gates of which are connected to each other. The drains of the tenth transistor T10 and the eleventh transistor T11 are connected to the drains of the eighth transistor T8 and the ninth transistor T9, respectively. The sources of the eighth transistor T8 and the ninth transistor T9 are connected to ground GND. The gates of the eighth transistor T8 and the ninth transistor T9 are connected to a control port VCNT.

3B shows an equivalent circuit diagram of another embodiment of an amplifier stage AS comprising 12 transistors T1-T12. A power supply PS is connected to the sources of the first transistor T1 and of the second transistor T2. The gates of the first transistor T1 and of the second transistor T2 are electrically connected to each other. The drains of the first transistor T1 and of the second transistor T2 are connected to the sources of the third transistor T3 and of the fourth transistor T4, respectively. Further, the drains are connected to drains of the fifth transistor T5 and of the sixth transistor T6, respectively. The gates of the fifth transistor T5 and of the sixth transistor T6 establish the respective first and second input terminals TIN1, TIN2 of the amplifier stage.

The sources of the fifth transistor T5 and of the sixth transistor T6 are connected to the drain of the eighth transistor T8. Further, the drains of the third transistor T3 and of the fourth transistor T4 are connected to drains of the seventh transistor T7 and of the ninth transistor T9 respectively and are connected to the output terminals TOUT1, TOUT2 of the output port. The gate of the third transistor T3 is connected to the gate of the fourth transistor T4. The gate of the seventh transistor T7 is connected to the gate of the eighth transistor T8 and to the gate of the ninth transistor T9. The sources of the seventh transistor T7 and of the ninth transistor T9 are connected to the drains of the tenth transistor T10 and of the twelfth transistor T12. The sources of the tenth transistor T10 and of the twelfth transistor T12 are connected to ground GND, as is the source of the eleventh transistor T11. The gate of the tenth transistor T10 is connected to the gate of the eleventh transistor T11 and to the gate of the twelfth transistor T12 and to a control port VCNT. The gate of the seventh transistor T7 is connected to the gate of the ninth transistor T9.

The first transistor T1 and the second transistor T2 are connected to a bias terminal and the third transistor T3 and the fourth transistor are connected to a bias terminal.

FIG. 4A shows a detailed circuit equivalent diagram of a common mode feedback circuit CMFBC comprising 8 transistors T1-T8. A power supply PS is connected to the sources of the first transistor T1 and the second transistor T2, the gates of which are connected to each other. The drains of the first transistor T1 and of the second transistor T2 are connected to the sources of a third transistor T3 and of a fifth transistor T5 and to the sources of a fourth transistor T4 and a sixth transistor T6, respectively. The gates of the fifth transistor T5 and of the sixth transistor T6 establish the terminals of the common mode feedback circuit's output port DOP. Further, the drains of the third transistor T3 and of the fourth transistor T4 are connected to the gate of a seventh transistor T7 and to the drain of the seventh transistor T7. The gate of the seventh transistor T7 is further connected to a control port VCNT. The source of the seventh transistor T7 is connected to ground and to the source of an eighth transistor T8. Further, the drains of the fifth transistor T5 and of the sixth transistor T6 are connected to the gate and to the drain of the eighth transistor T8. Gates of the third transistor T3 and the forth transistor t4 are connected together and connected to a port VCOM.

FIG. 4B shows an equivalent circuit diagram of another embodiment of a common mode feedback circuit CMFBC. The common mode feedback circuit CMFBC comprises four capacitance elements CE where each two capacitance elements are connected in series and two series of capacitance elements are connected in parallel. Switches SW can be utilized to electrically connect or disconnect capacitance elements. The common mode feedback circuit CMFBC comprises a first output terminal TOUT1 and a second output terminal TOUT2 forming a differential output port, control port VCNT, and a common mode voltage port VCOM.

Figure 5:
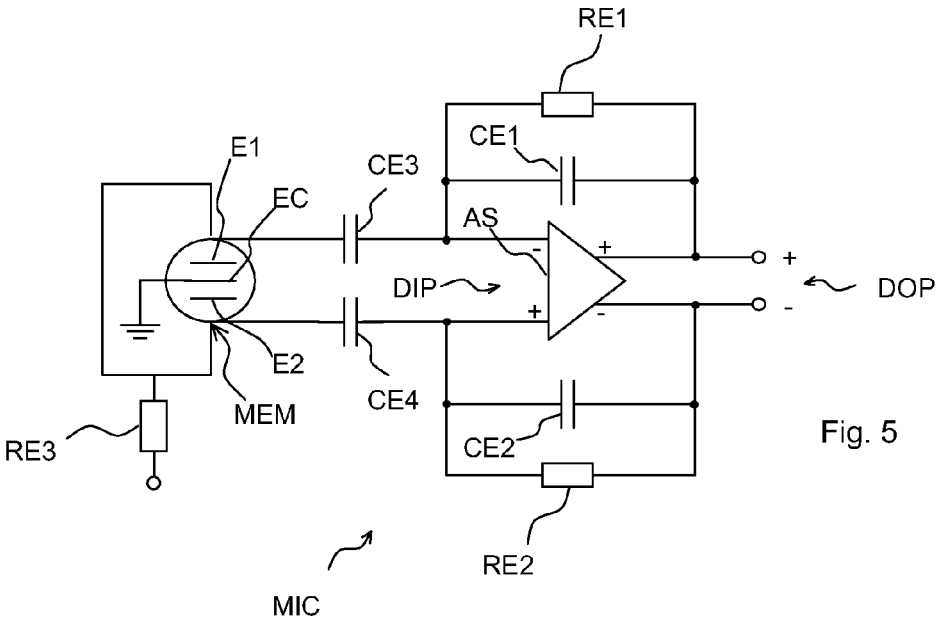
FIG. 5 shows an equivalent circuit diagram of a microphone.

FIG. 5 shows an equivalent circuit diagram of a microphone MIC comprising a third capacitance element CE3 and a fourth capacitance element CE4 and a third resistance element RE3. The third capacitance element CE3 is connected to an input terminal of the differential input port DIP. The fourth capacitance element CE4 is connected to the respective other input terminal of the differential input port DIP. Further the third resistance element RE3 is connected between the microphone electrodes (or membranes) and an on-chip generated bias voltage source. The other side of the resistance element is connected to the third and fourth capacitance element which are also connected to the terminals of the amplifier stage AS.

Figure 6:
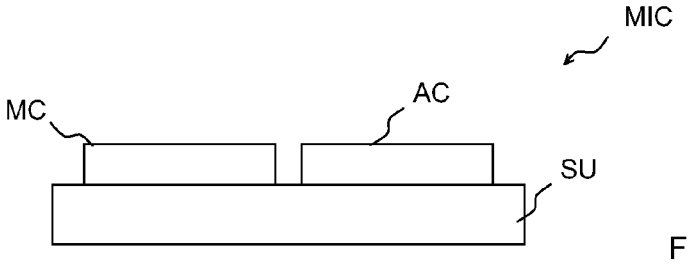
FIG. 6 shows a cross section of a microphone.

FIG. 6 shows a cross section of a microphone assembly MIC comprising a MEMS chip MC containing the microphone's acoustical elements and an ASIC chip AC containing the circuit elements. The microphone chip MC and the ASIC chip AC are arranged on a substrate SU. It is, however, possible that the acoustical and the electrical elements of a microphone are integrated in a single chip, e.g., a silicon chip.

A differential microphone is not limited to the embodiments described in the specification or shown in the figures. Amplifiers comprising further elements, e.g., such as capacitance elements, resistance elements, transistors, electrodes, or further input or output ports are also comprised by the present invention.

The invention claimed is:

1. A differential microphone comprising:

a first microphone electrode;

a central microphone electrode;

a second microphone electrode;

an output port configured as a differential port;

a differential amplifier stage having a differential input port and a differential output port that is connected to the output port of the microphone; and a common mode feedback circuit having a differential port that is connected to the output port of the microphone, wherein the first microphone electrode and the central microphone electrode establish a first capacitive element and the central microphone electrode and the second microphone electrode establish a second capacitive element, and wherein the first and second capacitive elements provide a differential capacitor output port.

2. The differential microphone according to claim 1, wherein a first terminal of the amplifier stage differential input port is connected to the differential capacitor output port and a second terminal of the amplifier stage differential input port is connected to the differential capacitor output port.

3. The differential microphone according to claim 1, wherein the amplifier stage has a control port and the common mode feedback circuit is connected to the control port.

4. The differential microphone according to claim 1, further comprising:

a first resistance element connected between a first terminal of the output port and a first terminal of the input port; and a second resistance element connected between a second terminal of the output port and a second terminal of the input port, wherein the first and the second resistance elements are part of an amplifier feedback circuit.

5. The differential microphone according to claim 4, wherein the first and second resistance elements each comprise a first diode and a second diode that is connected in parallel to and in an opposite direction of the first diode.

6. The differential microphone according to claim 1, wherein the common mode feedback circuit comprises a common mode voltage port for setting and adjusting the common mode voltage at the amplifier stage output port.

7. The differential microphone according to claim 1, further comprising:

a first capacitance element and a second capacitance element;

wherein the first capacitance element is connected between a first terminal of the output port and a first terminal of the amplifier stage's input port;

wherein the second capacitance element is connected between a second terminal of the output port and a second terminal of the amplifier stage input port; and wherein the first and the second capacitance elements are part of an amplifier feedback circuit.

8. The differential microphone according to claim 1, wherein the first microphone electrode, the central microphone electrode and the second microphone electrode are elements of an acoustically active part of a Micro Electro Mechanical System (MEMS) microphone or a electret condenser microphone.

9. The differential microphone according to claim 1, further comprising:

a third capacitance element connected between a first terminal of the amplifier stage input port and the first microphone electrode; and a fourth capacitance element connected between a second terminal of the amplifier stage input port and the second microphone electrode.

10. The differential microphone according to claim 1, further comprising:

a third resistance element connected between the first microphone electrode and a high bias voltage generated by an integrated circuit, wherein the first microphone electrode and the second microphone electrode are electrically connected.

11. The differential microphone according to claim 1, wherein the amplifier stage comprises:

a first, a second, a third, a fourth, a fifth, a sixth, a seventh, an eighth, a ninth, a tenth and an eleventh transistor, wherein:

the first, the second and the third transistors are connected to a power supply, the fourth transistor is connected between the second and the sixth transistors and the fifth transistor is connected between the third transistor and the seventh transistor, the eighth transistor is connected between the sixth transistor and ground and the ninth transistor is connected between the seventh transistor and ground, the tenth transistor is connected between the first transistor and the eighth transistor and the eleventh transistor is connected between the first transistor and the ninth transistor the eighth transistor and the ninth transistor are connected to a control port.

12. The differential microphone according to claim 1, wherein the amplifier stage comprises:

a first, a second, a third, a fourth, a fifth, a sixth, a seventh, an eighth, a ninth, a tenth, an eleventh and a twelfth transistor, where the first transistor and the second transistor are connected to a power supply, the third transistor is connected between the first transistor and the seventh transistor and the fourth transistor is connected between the second transistor and the ninth transistor, the fifth transistor is connected between the first transistor and the eighth transistor and the sixth transistor is connected between the second transistor and the eighth transistor, the seventh transistor is connected between the third transistor and the tenth transistor and the ninth transistor is connected between the fourth transistor and the twelfth transistor, the eighth transistor is connected to the eleventh transistor, the tenth transistor, the eleventh transistor and the twelfth transistor are connected to ground, and the tenth transistor, the eleventh transistor and the twelfth transistor are connected to a control port.

13. The differential microphone according to claim 1, wherein the common mode feedback circuit comprises:

a first, a second, a third, a fourth, a fifth, a sixth, a seventh and an eighth transistor, where the first and the second transistors are connected to a power supply, the third transistor is connected between the first transistor and the seventh transistor, the fourth transistor is connected between the second transistor and the seventh transistor, the fifth transistor is connected between the first transistor and the eighth transistor, the sixth transistor is connected between the second transistor and the eighth transistor, the seventh transistor and the eighth transistor are connected to ground, the third transistor, the fourth transistor and the seventh transistor are connected to a control port, and the third transistor and the fourth transistor are connected to a common mode voltage port.

14. The differential microphone according to claim 1, wherein all circuit elements of the differential amplifier stage are fully integrated in a Complementary Metal Oxide Semiconductor (CMOS) Application Specific Integrated Circuit (ASIC) chip.

15. A method for driving a differential microphone according to claim 1, the method comprising:

receiving an acoustical signal;

converting the acoustical signal into an electrical signal; and adjusting a bias voltage of the first and second microphone electrode by adjusting a common mode voltage via a common mode voltage port of the common mode feedback circuit.

16. The method according to claim 15, wherein the electrical signal is amplified with an adjustable and well defined gain insensitive to parasitic capacitances.

17. An apparatus comprising:

the differential microphone according to claim 1, wherein the first microphone electrode, the central microphone electrode and the second microphone electrode are electrodes of Micro Electro Mechanical Systems (MEMS) capacitors.

18. The apparatus according to claim 17, wherein the first microphone electrode and the central microphone electrode establish a first capacitive element, and wherein the central microphone electrode and the second microphone electrode establish a second capacitive element.

19. A differential microphone comprising:

a first microphone electrode;

a central microphone electrode;

a second microphone electrode;

an output port configured as a differential port;

a differential amplifier stage having a differential input port and a differential output port that is connected to the output port of the microphone; and a common mode feedback circuit having a differential port that is connected to the output port of the microphone, wherein the first microphone electrode and the central microphone electrode establish a first capacitive element and the central microphone electrode and the second microphone electrode establish a second capacitive element, wherein the first and second microphone electrodes are diaphragms and the central microphone electrode is a backplate, and wherein the first and second capacitive elements provide a differential capacitor output port.

20. A differential microphone comprising:

a first microphone electrode;

a central microphone electrode;

a second microphone electrode;

an output port configured as a differential port;

a differential amplifier stage having a differential input port and a differential output port that is connected to the output port of the microphone; and a common mode feedback circuit having a differential port that is connected to the output port of the microphone, wherein the first microphone electrode and the central microphone electrode are configured to provide a first differential signal based on a first capacitive element to the differential amplifier stage and the central microphone electrode and the second microphone electrode are configured to provide a second differential signal based on a second capacitive element to the differential amplifier stage.

* * * * *